US011457516B2

(12) United States Patent
Fu

(10) Patent No.: US 11,457,516 B2
(45) Date of Patent: Sep. 27, 2022

(54) DRIVER ARRANGEMENT FOR A LED LIGHTING DEVICE, A LIGHTING DEVICE USING THE SAME AND A DRIVE METHOD

(71) Applicant: SIGNIFY HOLDING B.V., Eindhoven (NL)

(72) Inventor: Jie Fu, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 41 days.

(21) Appl. No.: 17/047,633

(22) PCT Filed: Apr. 17, 2019

(86) PCT No.: PCT/EP2019/059963
§ 371 (c)(1),
(2) Date: Oct. 14, 2020

(87) PCT Pub. No.: WO2019/206771
PCT Pub. Date: Oct. 31, 2019

(65) Prior Publication Data

US 2021/0378067 A1 Dec. 2, 2021

(30) Foreign Application Priority Data

Apr. 23, 2018 (WO) ..... PCT/CN2018/084066
Jul. 2, 2018 (EP) ..... 18181200

(51) Int. Cl.
*H05B 47/11* (2020.01)
*H05B 45/10* (2020.01)
(Continued)

(52) U.S. Cl.
CPC ..... *H05B 45/10* (2020.01); *H05B 45/34* (2020.01); *H05B 45/357* (2020.01);
(Continued)

(58) Field of Classification Search
CPC .... H05B 45/00; H05B 45/37; H05B 45/3725; H05B 45/3578; H05B 45/18; H05B 45/395; H05B 45/397; Y02B 20/30
See application file for complete search history.

(56) References Cited

U.S. PATENT DOCUMENTS 9,826,583 B1 11/2017 Xiong et al.
2016/0366732 A1* 12/2016 Radermacher ..... H05B 45/3725
2017/0202063 A1 7/2017 Saes

FOREIGN PATENT DOCUMENTS

DE 102013107770 A1 1/2015
EP 3305022 A1 4/2018
(Continued)

*Primary Examiner* — Henry Luong
(74) *Attorney, Agent, or Firm* — Daniel J. Piotrowski

(57) ABSTRACT

A driver arrangement is provided for a LED lighting device with a LED light source and at least one additional auxiliary module. The driver arrangement comprises separate main and auxiliary drivers. The delivery of power from the auxiliary driver is controlled to either an auxiliary power output or to both a main power output and the auxiliary power output. Each driver can be optimized for the load it is required to drive. The device may overall be more efficient in a low power auxiliary mode, by using a driver suited for such low power operation. In particular when the power demand of the LED light source is low, the auxiliary driver may be used.

14 Claims, 5 Drawing Sheets

(51) Int. Cl.

| | |
|---|---|
| ***H05B 45/3725*** | (2020.01) |
| ***H05B 45/34*** | (2020.01) |
| ***H05B 45/357*** | (2020.01) |
| *H05B 45/375* | (2020.01) |
| *H05B 45/38* | (2020.01) |
| *H05B 45/385* | (2020.01) |
| *H05B 47/19* | (2020.01) |

(52) U.S. Cl.
CPC ..... *H05B 45/3725* (2020.01); *H05B 47/11* (2020.01); *H05B 45/375* (2020.01); *H05B 45/38* (2020.01); *H05B 45/385* (2020.01); *H05B 47/19* (2020.01)

(56) References Cited

FOREIGN PATENT DOCUMENTS

| | | | | | |
|---|---|---|---|---|---|
| WO | WO-2013090945 | A1 * | 6/2013 | ..... | F21K 9/135 |
| WO | 2015128388 | A1 | 9/2015 | | |
| WO | 2015185570 | A1 | 12/2015 | | |

* cited by examiner

DRIVER ARRANGEMENT FOR A LED LIGHTING DEVICE, A LIGHTING DEVICE USING THE SAME AND A DRIVE METHOD

CROSS-REFERENCE TO PRIOR APPLICATIONS

This application is the U.S. National Phase application under 35 U.S.C. § 371 of International Application No. PCT/EP2019/059963, filed on Apr. 17, 2019, which claims the benefits of European Patent Application No. 18181200.9, filed on Jul. 2, 2018 and Chinese Patent Application No. PCT/CN2018/084066, filed on Apr. 23, 2018. These applications are hereby incorporated by reference herein.

FIELD OF THE INVENTION

This invention relates to LED lighting systems and drivers, and relates in particular to lighting systems in which additional functionality is integrated into the luminaires of the lighting system, for example for sensing or communication purposes.

BACKGROUND OF THE INVENTION

In complex lighting systems, for example smart lighting systems in which luminaires include local sensors and/or communications modules, a power supply is needed which generates multiple outputs. An auxiliary supply is needed, in addition to the main supply for the lighting load, for supplying master control units, logic circuits, gate drivers sensors and/or communications modules etc.

An issue with the provision of these additional functions is that the standby power consumption becomes an issue. There are regulatory standby power consumption requirements for lamps or stand-alone LED drivers below 500 mW. For example, the California Energy Commission is pushing ahead with a requirement for a 0.2 W maximum standby power for connected lamps.

In order to achieve this low standby power consumption target, a standalone auxiliary power supply is widely adopted in an LED driver. There is then a standby power supply separate to the main LED driver, which functions as the power supply for the lighting load.

A dimming function is a common feature provided by a LED driver. When the LED driver power is dimmed down, the efficiency is very important in order to provide energy savings. The LED driver must be designed according to the maximum power requirements, so large current rating components are used in the design which means the high-efficiency region is at the average to high power/load and the efficiency of LED driver at a light load is low. The typical efficiency is as shown in FIG. 1, which plots the efficiency (E, y-axis) versus the loading as a percentage of the rated load. There is a particular efficiency issue at low load conditions.

There is therefore a need to enable improved efficiency in a driver for a LED light source and which enables additional modules to be provided with a low standby power requirement.

WO2015128388A1 discloses a two-driver architecture wherein a switched mode power supply's input current can be regulated according to whether a capacitor of a linear driver is being charged at the peak of the mains, so as to provide good power factor and less flicker, meanwhile obtain a homogenous light output.

WO2015185570A1 discloses an emergency lamp with a LED driver to power the LED, and a DC-DC converter to power the LED from a battery when there is emergency, power cut on the supply.

U.S. Pat. No. 9,826,583B1 discloses an auxiliary power supply, in an LED driver, that powers an external controller which is for controlling a controller in the LED driver.

SUMMARY OF THE INVENTION

The invention is defined by the claims.

It is a concept of the invention to make use of an auxiliary driver to deliver power to a LED lighting load, instead of a main LED driver, when the LED power demand is sufficiently low that it can be met by the auxiliary driver. The auxiliary driver is generally still a low power driver when supplied by the AC mains and is originally only intended for auxiliary modules, such as sensors and communications circuits, and has a power delivery capability which is lower than the peak power demand of the LED lighting load. By reusing the auxiliary driver when supplied by the AC mains for powering the LED, operation of the main LED driver at low power level when supplied by the AC mains is reduced or prevented, and low power efficiency of the main LED driver when supplied by the AC mains is avoided.

According to examples in accordance with an aspect of the invention, there is provided a driver arrangement for a LED lighting device with a LED light source and at least one additional auxiliary module, the driver arrangement comprising:

a main power output for providing power to the LED light source;

a main LED driver having a main power conversion circuit, the main LED driver connected to the main power output;

an auxiliary power output for providing power to the at least one additional auxiliary module;

an auxiliary driver, wherein the auxiliary driver has an auxiliary power conversion circuit independent from the main LED driver; and a controller for controlling the ratio of delivery of power from the auxiliary driver to the main power output and the auxiliary power output;

wherein the controller is adapted to communicate over a command connection to receive a dimming command of the LED driver; and control the auxiliary driver to provide power to the LED light source when the output power of the LED light source is set, in accordance with the dimming command, lower than a threshold value.

The controller for example controls the delivery of power from the auxiliary driver to the auxiliary power output or to both the main power output and the auxiliary power output.

This driver arrangement has separate drivers for an LED lighting device and for one or more auxiliary modules. In this way, each driver can be optimized for the load it is required to drive. This means that the device may be more efficient in a low power lighting mode, by using a driver suited for such low power operation. In addition to providing at least two independent drivers, the output of the auxiliary driver is able to be used to power the LED light source. This may for example be appropriate when the power demand of the LED light source is low, for example during periods of deep dimming. By using the auxiliary driver for this time, the overall efficiency of the driver arrangement may be improved.

Thus, when the LED light source power demand is low, the auxiliary driver may be used to deliver the required power more efficiently that the main LED driver.

In a further embodiment, the command connection is different from the AC mains, and the main LED driver and the auxiliary driver are both adapted to power the LED from the AC mains, and the rate maximum power of the auxiliary driver is lower than the rate maximum power of the main LED driver, but the auxiliary driver has a high efficiency than that of the main LED driver at the set output power lower than the threshold value. These technical features enables that the selection of the driver is a more proactive manner to achieve better efficiency.

Preferably, the command connection is a wireless connection.

The controller may comprise a power control loop comprising a sensor for sensing a power delivery to the LED light source from the auxiliary driver and to control a power delivery to the LED light source from the main driver accordingly.

The power control loop is for the main LED driver and comprises a sensor for sensing a power delivery to the LED light source from the auxiliary driver or from both of the main LED driver and the auxiliary driver. The power control loop is adapted to control a power delivery to the LED light source from the main power conversion circuit such that the power delivery to the LED light source matches an output power demand of the LED light source.

In this way, it is ensured that the total power delivery to the LED light source is correct, by monitoring the contribution from the auxiliary supply and controlling the main driver accordingly.

The controller is preferably adapted to control the delivery of power in dependence on the power demand of the LED light source and of the at least one additional auxiliary module.

The decision of whether to use the output power of the auxiliary driver either for the auxiliary module (or modules) or additionally for the LED light source thus takes account of both power demands. If both can be met by the auxiliary driver, then it will be used as the sole power supply. If both cannot be met by the auxiliary driver, then the auxiliary driver should not be overloaded and preferably the two drivers will both be used.

The controller is for example adapted to retrieve the power demand of the at least one additional auxiliary module by:

receiving signaling from the at least one additional auxiliary module; or detecting the output power of the auxiliary driver when it does not output power to the LED light source.

There are thus various ways to provide detection which allows the correct total power to be delivered to the LED light source and to the auxiliary modules.

The controller may be adapted to set the power output of the auxiliary driver to be the smaller of:

the peak output power of the auxiliary driver; and a sum of the power demand of the at least one additional auxiliary module an output power demand of the LED light source.

In this way, the output power of the auxiliary driver is set to a sum of the power demand of the at least one additional auxiliary module and the output power demand of the LED light source. If this sum exceeds the peak power output capability of the auxiliary driver, then it is set to the peak power. This means that the auxiliary driver alone is used whenever possible. Whenever the total power demand cannot be met only by the auxiliary driver, then the auxiliary driver is driven to its full power, and the surplus additional power requirement is delivered by the main LED driver. This means the efficiency is improved, because the auxiliary driver is always responsible for the lowest tranche of power demand.

The auxiliary driver for example comprises a constant voltage driver for the additional modules. The additional modules for example then comprise input/output power control capability so that they can function properly from a constant voltage power supply.

Preferably, when the sum is higher than the peak output power, namely the auxiliary driver needs to work at its peak output power, the controller is adapted to maintain a peak current corresponding to the peak output power of the auxiliary driver, meanwhile regulating the voltage on the auxiliary power output.

When the sum is lower than the peak output power, namely the auxiliary driver does not work at its peak output power, the controller is adapted to maintain a current corresponding to the output power demand of the LED light source meanwhile regulating the voltage on the auxiliary power output.

This preferred embodiment defines the feedback control loop for the auxiliary driver.

The auxiliary driver may comprise a main power inductor and a first secondary inductor magnetically coupled to the main power inductor and adapted to connect to the at least one additional auxiliary module. This provides an isolated supply to the auxiliary module. Further, there may be a second secondary inductor for providing a second isolated supply to a different type of auxiliary module. The two secondary inductors may give rise to different transformer ratios so that the outputs voltage can be different and are adapted to the different types of auxiliary loads to be supplied, such as 5V loads and 12V loads etc.

The main power inductor is for example adapted to connect to the LED light source, in an electrically direct manner. Alternatively, the auxiliary driver comprises a further secondary inductor magnetically coupled to the main power inductor and adapted to connect to the LED light source. This means that both supplies are isolated.

The invention also provides a lighting device comprising:

a LED light source;

at least one additional auxiliary module; and a driver arrangement as defined above; wherein said at least one additional auxiliary module is adapted to regulate its input power from the auxiliary driver at the auxiliary power output.

This provides a lighting device which incorporates the driver arrangement described above.

The at least one additional auxiliary module may comprise:

an RF communication device; or a sensor device.

Different possible auxiliary modules are possible. There may be a single module or multiple modules. They are used to form a network of devices. Typically, the modules add functionality to the light system, such as based on presence detection, ambient light sensing etc. However, the modules may be provided for other purposes, for example as part of an intruder detection system, or sensors for controlling a heating, ventilation and air conditioning system (HVAC).

The invention also provides a method of controlling the supply of power from a driver arrangement to a LED lighting device with a LED light source and to at least one additional auxiliary module, the method comprising:

providing power to the LED light source (14) using a main LED driver having a main power conversion circuit;

providing power to the at least one additional auxiliary module (16) using an auxiliary driver, wherein the auxiliary driver has an auxiliary power conversion circuit independent from the main LED driver;

communicating over a command connection to receive a dimming command of the LED driver; and selectively controlling the delivery of power from the auxiliary driver to only the at least one additional auxiliary module or to both the at least one additional auxiliary module and the LED light source, wherein controlling the auxiliary driver to provide power to the LED light source when the output power of the LED light source is set, in accordance with the dimming command, lower than a threshold value.

The selective control of power delivery enables efficiency improvements to be obtained, by avoiding operating a high power driver at very low power demand levels. A power delivery to the LED light source from the auxiliary driver may be sensed so that a power delivery to the LED light source is then controlled from the main LED driver accordingly. Selectively controlling the delivery of power is for example in dependence on the power demand of the LED light source and of the at least one additional auxiliary module.

By way of example, the method may comprise setting the power output of the auxiliary driver to be the smaller of:

the peak output power of the auxiliary driver; and a sum of the power demand of the at least one additional auxiliary module an output power demand of the LED light source.

Thus, the auxiliary driver is used preferentially for low power demands.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
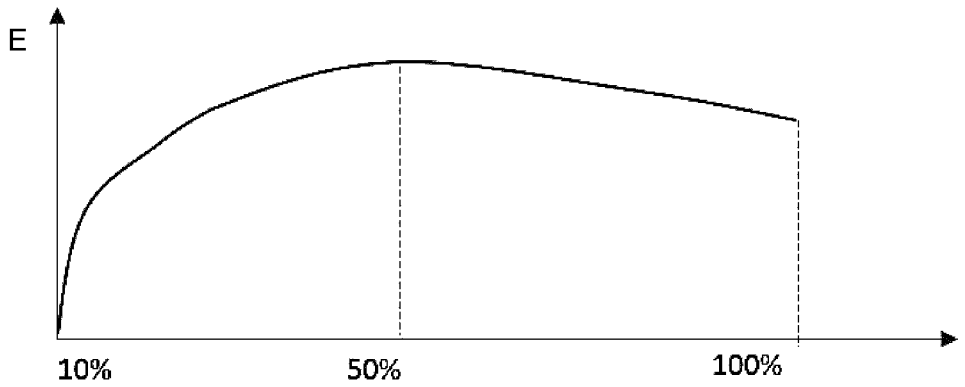
FIG. 1 shows the typical energy efficiency of a LED driver at different load conditions.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a driver arrangement for a LED lighting device, in which the lighting device has a LED light source and at least one additional auxiliary module. The driver arrangement comprises separate main and auxiliary drivers. The delivery of power from the auxiliary driver is controlled to either an auxiliary power output or to both a main power output and the auxiliary power output. Each driver can be optimized for the load it is required to drive. The device may overall be more efficient in a low power mode, by using a driver suited for such low power operation. In particular, when the power demand of the LED light source is low, the auxiliary driver may be used.

Figure 2:
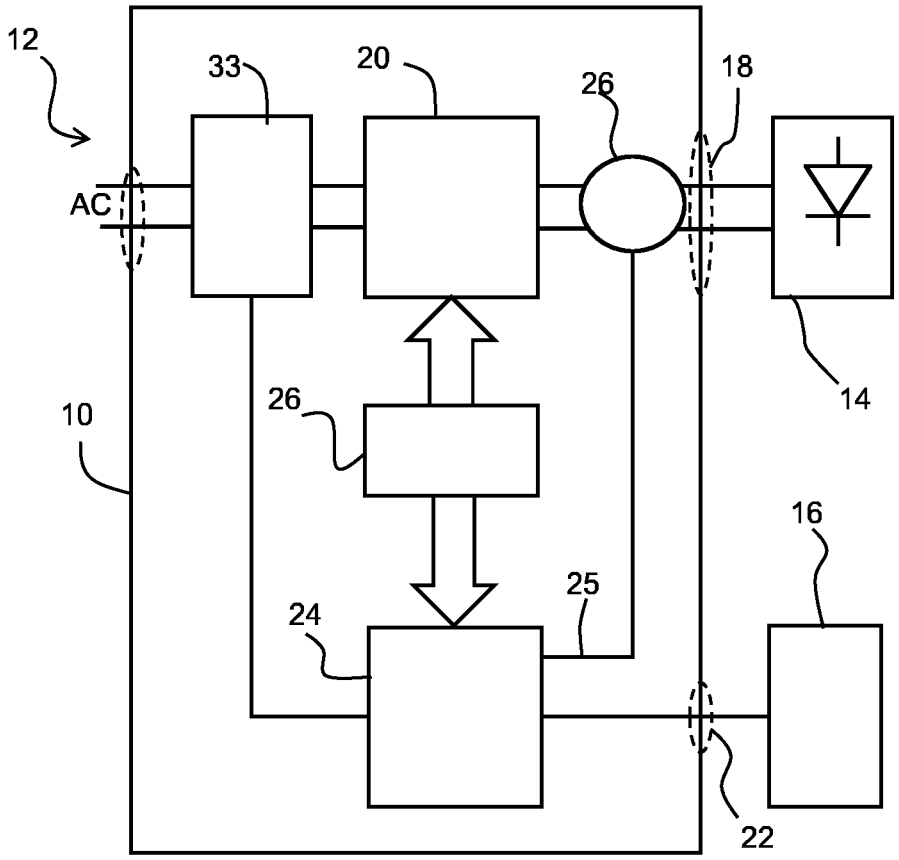
FIG. 2 shows a driver arrangement for a LED lighting device in accordance with an example of the invention.

FIG. 2 shows a driver arrangement 10 for a LED lighting device 12 with a LED light source 14 and at least one additional auxiliary module 16. In FIG. 2, the lighting device is defined as the overall system, including the light source, the driver arrangement and the auxiliary modules.

The driver arrangement 10 has a main power output 18 for providing power to the LED light source 14. A main LED driver 20 is connected to the main power output 18. It comprises a switch mode power supply, having a main power conversion circuit.

Alternatively the main LED driver could also be a linear power supply or other type of power supply instead of the switch mode power supply. An auxiliary power output 22 is provided for providing power to the at least one additional auxiliary module 16. An auxiliary driver 24 is connected to the auxiliary power output 22. The auxiliary driver 24 also comprises a switch mode power supply, having an auxiliary power conversion circuit independent from the main LED driver 20. Alternatively the auxiliary driver 24 could also be other types of power supply. The main LED driver and the auxiliary driver 24 usually are connected in parallel and both to the input like AC or DC grid.

A controller 26 is used to control the two drivers. In particular, the power from the auxiliary driver may be controlled to be provided only to the auxiliary power output or to both the main power output and the auxiliary power output. Namely the ratio of power from the auxiliary driver to the LED and the additional modules is adjustable. For this purpose, the auxiliary driver 24 has an output 25 which is combined with the output of the main driver at combiner 26 before delivery to the LED light source 14.

This driver arrangement has separate drivers for the LED lighting source and for auxiliary modules. In this way, each driver can be optimized for the load it is required to drive. This means that the device may be more efficient in a low power lighting mode, by using a driver suited for such low power operation. The auxiliary driver is for example used to power the LED light source when the power demand of the LED light source is low, for example during periods of deep dimming. By using the auxiliary driver for this time, the overall efficiency of the driver arrangement may be improved.

The auxiliary power supply is thus used to replace the low-efficiency main LED driver during light load conditions thereby to achieve more efficient LED driver operation over the full load range.

By way of example, the main LED driver 20 may be designed to operate at a maximum load of 100 W whereas the auxiliary driver may be designed to operate with a maximum load of 10 W. More generally, the peak power delivery of the main driver is more than 3 times, preferably more than 5 times, and preferably more than 8 times the peak power delivery of the auxiliary driver.

For the example of 100 W and 10 W, when the LED driver is instructed to dim down to below a 10% load level, and hence below 10 W, the auxiliary power supply can then be used to supply the LED light source. This results in a more efficient operation than if the main LED driver is used. The load of the auxiliary power supply is typically variable over time (sensors are for example activated periodically or communications are intermittent) so the auxiliary driver is not always operated at a full load condition, and part of the load capacity is often available for use in supplying the LED light source.

Figure 3:
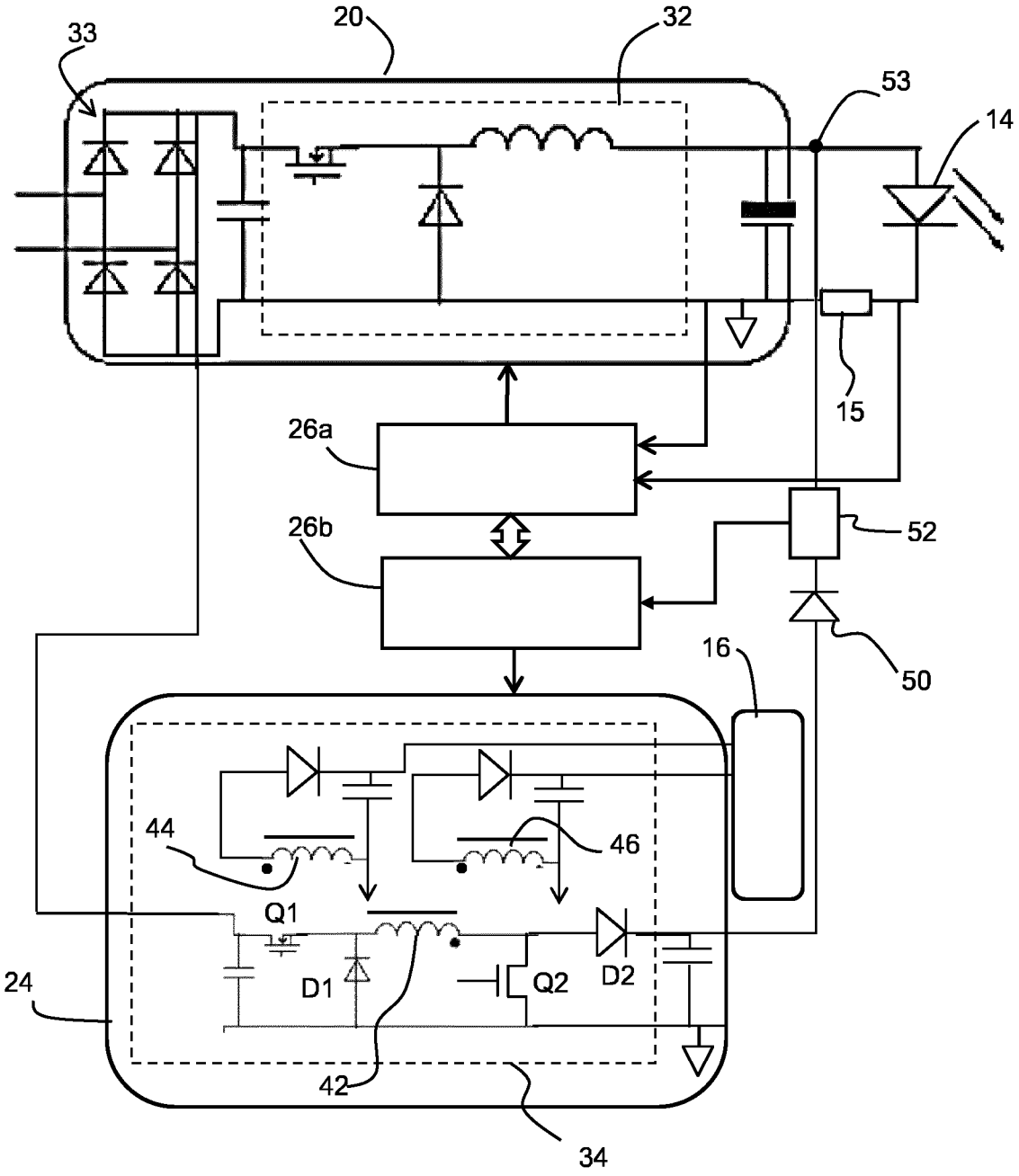
FIG. 3 shows one example of the circuit of FIG. 2 in more detail.

FIG. 3 shows one example of the circuit in more detail.

The main driver 20 has a main power conversion circuit 32 and a rectifier 33. The main power conversion circuit is a switch mode power converter, which is shown as a buck converter in this example. A current sense resistor 15 enables sensing of the LED current, for example for providing feedback control.

The controller 26 is shown as two separate control units, one 26*a* for the main driver power supply and one 26*b* for the auxiliary driver power supply.

The auxiliary driver 24 has an auxiliary power conversion circuit 34. It also comprises a buck-boost converter architecture with a main inductor 42. The auxiliary power conversion circuit is supplied by the rectified signal from the main converter rectifier 33, and it generates an output suitable for the LED light source 14.

The auxiliary driver 24 shown has a dual switch topology, with two switching transistors Q1 and Q2 controlled with same driver signal sequence and two diodes D1 and D2. The output is switchable to the LED light source 14 by controlling the output voltage.

The output of the auxiliary driver 24 is provided to the LED light source 14 through an output diode 50. Thus, an output current from the auxiliary driver can be prevented from reaching the LED light source if the output voltage is kept below the LED string voltage. The current provided is sensed by sensor 52 and this sensing information is provided to the controller 26*b*. The node 53 shown in FIG. 3 may be considered to correspond to the combiner 26 of FIG. 2.

The auxiliary driver further has a flyback topology for supplying the additional modules, and has a first secondary side power output circuit having a first secondary side inductor 44, and a second secondary side power output circuit having a second secondary side inductor 46. Those two first secondary side inductors are magnetically coupled to the main inductor 42 in a flyback manner so as to freewheel power when the switches Q1 and Q2 are off. These two power output circuits provide different output power supplies for different types of auxiliary circuit 16.

Figure 4:
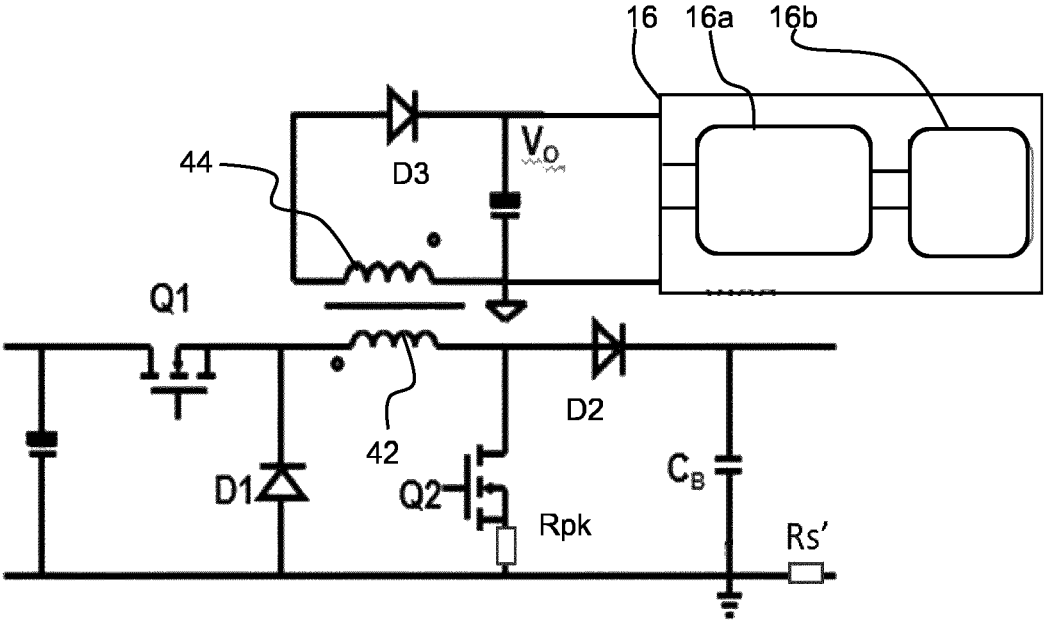
FIG. 4 shows the auxiliary driver in more detail.

FIG. 4 shows the auxiliary driver 24 in more detail. A first current sense resistor Rpk is provided for measuring the peak primary side current Ipk in the boost charging phase, and a second current sense resistor Rs' is provided for measuring the output current to the LED light source. The second current sense resistor can be represented schematically in FIG. 3 as the sensor 52. In the boost charging phase, both switches Q1 and Q2 are on, the power is accumulated in the main inductor 42; in the freewheeling phase, the main inductor 42 discharges to the buffer capacitor $C_B$, in turn to the LEDs, via the diode D2, and also the secondary inductor 44 discharges via the diode D3 and to the additional modules.

The power supply for the auxiliary modules is for example a fixed voltage Vo, and the auxiliary load 16 for example comprises a low drop out regulator or switch mode power supply 16*a* followed by a master control unit or sensor 16*b*. The consumed power Po depends on the power consumption of the controller or sensor and the preceding converter/regulator.

The parameters of current in the charging phase, the current though to the LEDs, and the voltage Vo may be used in the feedback control loop of the auxiliary driver, which will be described later.

Figure 5:
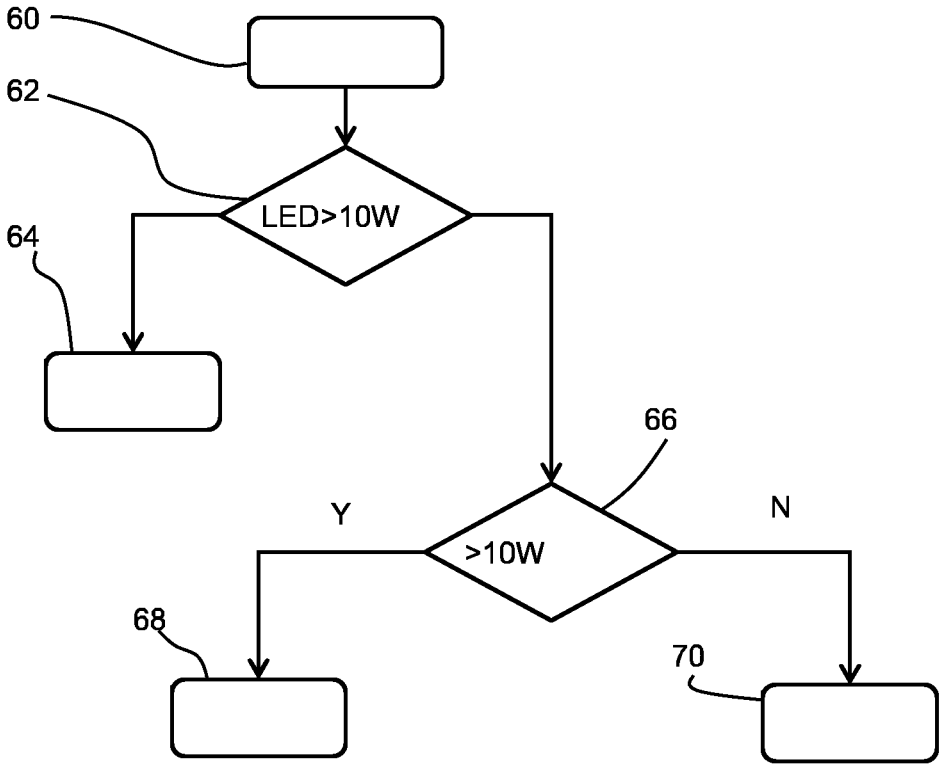
FIG. 5 shows one example of the control method implemented by the controller.

FIG. 5 shows one example of the control method implemented by the controllers 26*a*, 26*b*.

In step 60, the power demand of the LED light source is obtained. This in particular relates to the dimming setting. This dimming setting is for example communicated to the controller 26*a* over a wireless connection (and the wireless communications circuitry is one of the auxiliary modules, powered by the auxiliary driver).

In step 62, it is determined if the LED load is greater than 10 W (for the example of a 100 W main driver and 10 W auxiliary driver). Thus, the current setting is at a level higher than 10% of the maximum. If the LED load demand is greater than 10 W, then the main driver is used to supply the LED load in step 64. The main driver and the auxiliary driver operate separately. This can be achieved by tuning the output of the auxiliary driver to be slightly lower than the LED string voltage drop, so that the auxiliary driver will not provide power to LED load.

If the LED load demand is not greater than 10 W, then in step 66, it is determined if the total load demand, namely the LED load demand and the power demand of the auxiliary modules, is greater than 10 W.

For determining the LED load demand, the controller 26*a* is aware of it since the dimming level is already known.

The auxiliary load demand can be obtained by detecting the primary winding current and current sense resistor voltage for the sense resistor Rpk, in particular when no power is being delivered to the LED load. Alternatively the controller can request the additional modules to inform its power demand.

For a flyback converter topology, the input power is given by:

$$\text{Pin}=\tfrac{1}{2}Lk*Ipk*Ipk*fs$$

This applies under discontinuous current mode (DCM). Ipk is the peak primary side current, fs is the switching frequency and Lk is the inductance. By selecting a fixed frequency flyback controller and using the design to make sure the circuit operates under DCM, the value Ipk represents the total auxiliary power.

The auxiliary power is thus given by subtracting the load contribution of the LED light source as provided by the auxiliary driver:

$$P(\text{auxiliary load})=\tfrac{1}{2}Lk*Ipk*Ipk*fs-\text{Vled}*V(Rs')/Rs'$$

Alternatively, the auxiliary load information can be directly given by the auxiliary load itself which include a microcontroller. The controller 26*b* can then make a judgement of whether the needed LED driver load and auxiliary load is larger than the set threshold (10 W in this example).

If the total demand is greater than 10 W, then the auxiliary driver operates at full rated power (i.e. it operates at 10 W). This 10 W comprises the auxiliary power (e.g. the power $P_{SB}$) and the balance ($10-P_{SB}$) is provided by the auxiliary driver to the LED light source. The remaining power is delivered by the main driver. This is step 68.

By setting the peak current Ipk of the primary winding in the auxiliary driver, the total output power is fixed, and also the additional module can regulate its input power as $P_{SB}$, so that the remaining power ($10-P_{SB}$) is automatically supplied to LED light source by setting the output voltage slightly higher than the LED string voltage. The main driver and the auxiliary driver then supply the LED load in parallel. In the main driver, due to the fact that the sensing resistor Rs is placed before the current return path (ground) to the auxiliary driver, the total LED current from both the main LED driver and the auxiliary driver is sensed by current sensing resistor Rs. The closed loop control then maintains the main LED driver at a setting to provide the required additional current output. The main driver will provide power corresponding to the dimming level power level minus ($10-P_{SB}$).

When the auxiliary driver is operated at full load condition, the peak current of the primary winding is set to:

$$\sqrt{(10*2/Lk/fs)}.$$

If the total demand is not greater than 10 W, then the main driver can be turned off and the auxiliary driver operates this total demand level, providing both the auxiliary power requirement and the LED load requirement. This is step 70.

Figure 6:
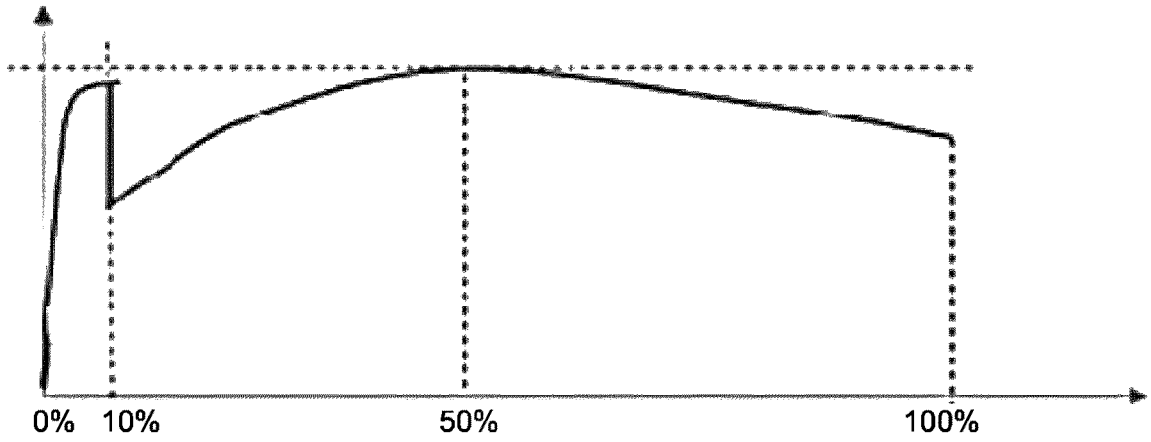
FIG. 6 shows the efficiency improvement achieved by adopting the architecture explained above.

FIG. 6 shows the efficiency improvement achieved by adopting the architecture explained above. The low power operation shows improved efficiency, since the auxiliary driver is used by default for lower power operation.

Figure 7:
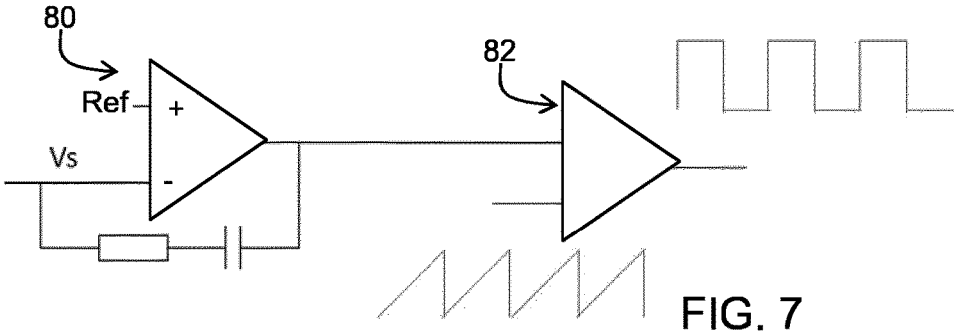
FIG. 7 shows an example of a control scheme for controlling the main driver.

FIG. 7 shows an example of a control scheme for controlling the main driver in response to the sensed voltage Vs across the current sense resistor Rs as long as it is involved, when the auxiliary driver does not provide power to the LED, or when the auxiliary driver provides power to the LED and the power is not enough (total power demand on the LED is more than the threshold (10 W)). The voltage Vs is compared with a reference voltage Ref which corresponds to the desired dimming level. A first amplifier circuit 80 generates an output signal based on a comparison between Vs and VLED and this is compared with a sawtooth reference waveform in a comparator 82 thereby generating a PWM gate control signal for the main driver.

Figure 8:
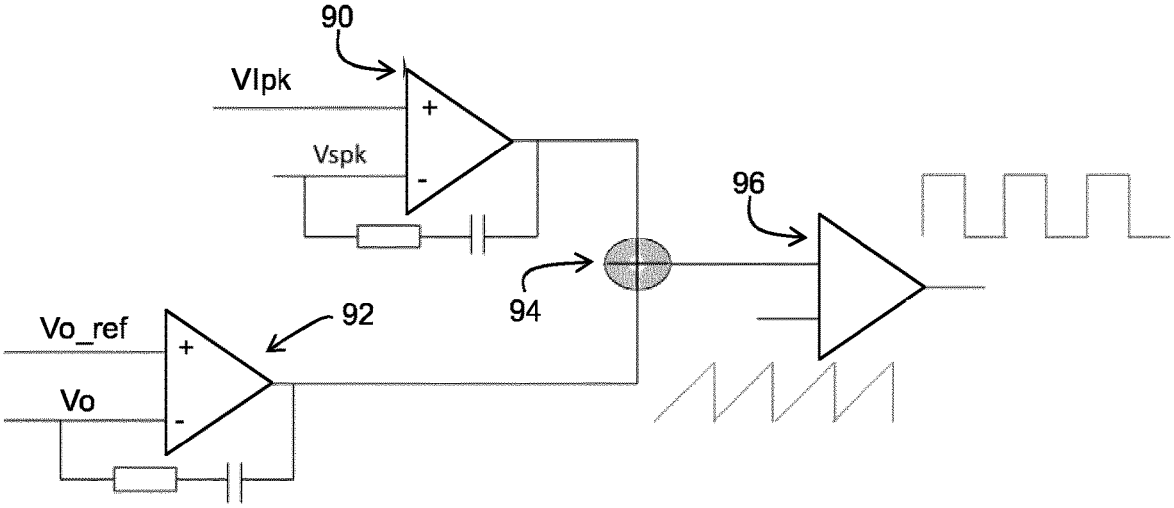
FIG. 8 shows an example of a control scheme for controlling the auxiliary driver.

FIG. 8 shows an example of a control scheme for controlling the auxiliary driver in response to the sensed voltage Vspk across the sense resistor Rpk when the auxiliary driver is outputting its peak power such as 10 W.

The voltage Vspk on the sensing resistor Rpk is compared with a reference voltage VIpk which corresponds to the peak primary current in order to provide the peak (10 W) output power. A first amplifier circuit 90 generates an output signal based on a comparison between VIpk and Vspk. This means if the real current at the charging phase is less than a peak charging current corresponding to 10 W, the duty cycle of the driver will be increased to increase the real current.

A second amplifier circuit 90 generates an output signal based on a comparison between the auxiliary driver output voltage Vo (shown in FIG. 4) and a desired output voltage setting Vo_ref. This means if the real output voltage Vo is less than the voltage reference, the duty cycle of the driver will be increased to increase the real output voltage. A summing unit 94 performs a sum operation.

The output of the unit 94 is provided to a comparator 96 whose other input is a saw tooth signal, thereby generating a PWM gate control signal for the auxiliary driver. More specifically, if the value Vo is much less than Vo_ref, or the real current is much less than the current corresponding to 10 W operation, the amplifier circuit will output a high value to the comparator 96, the high value is compared with the saw tooth wave giving rise to a high duty cycle. The comparator thus outputs longer high state period, thereby to increase the on time of the switches Q1 and Q2 to increase power charging, thereby increasing the power of the driver in order to increase the value of Vo or the real current. An opposite function takes place when the value Vo is high or the current is high, leading to a low duty cycle and reduced on time of the switches Q1 and Q2.

If the required LED driver load and auxiliary load is lower than 10 W, the main LED driver will be turned off and the auxiliary driver will provide the combined power. The auxiliary driver only needs to obtain the dimming command of LED driver and detect the additional module's load (or receive load information from a load controller), and it can adjust the on time of the auxiliary driver switch to make sure the total output power matches the needed LED power and auxiliary load based on closed loop control.

Figure 9:
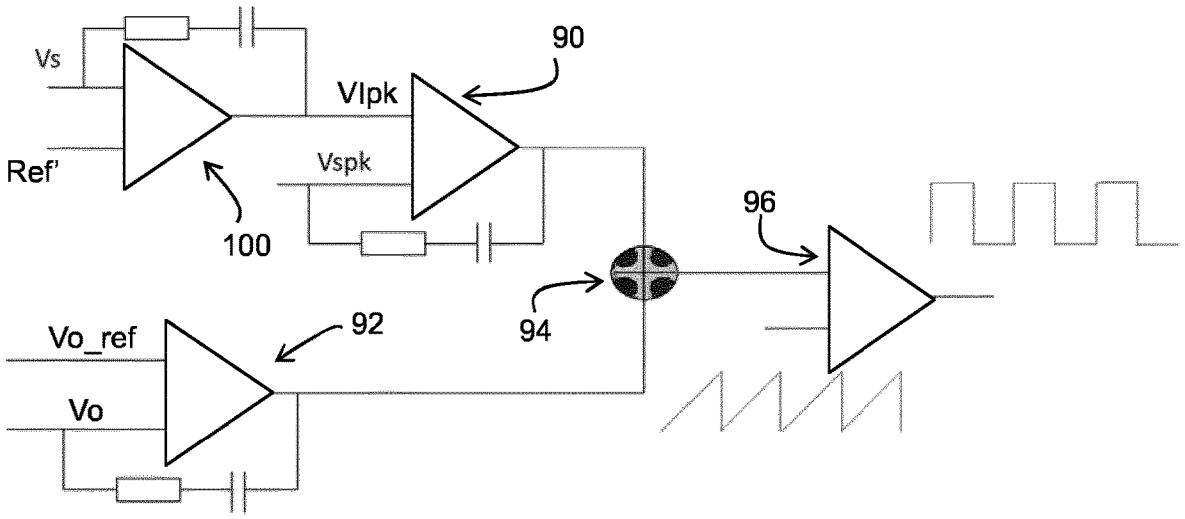
FIG. 9 shows a control scheme for use when the total power requirement is less than a threshold.

FIG. 9 shows a control scheme for use when the total power requirement is less than the threshold (10 W). Instead of the amplifier 90 having a reference corresponding to the maximum power setting, a further amplifier 100 is provided for generating the reference for the amplifier 90. The further amplifier 100 compares the voltage Vs across the main driver current sense resistor Rs which corresponds to the output current to the LED, with the reference voltage Ref' which corresponds to a current matching the desired dimming level. This then generates the reference VIpk of the amplifier 90 to compare with the Vspk of the charging phase current, which reference VIpk is below the maximum power setting used as a static reference in FIG. 8. The feedback control loop also comprises a comparison of the output voltage Vo with a reference, and comparison with a saw tooth wave to generate the signal to control the duty cycle of the switches Q1 and Q2. Those two portions are similar to those in FIG. 8, and thus will not be described again.

Figure 10:
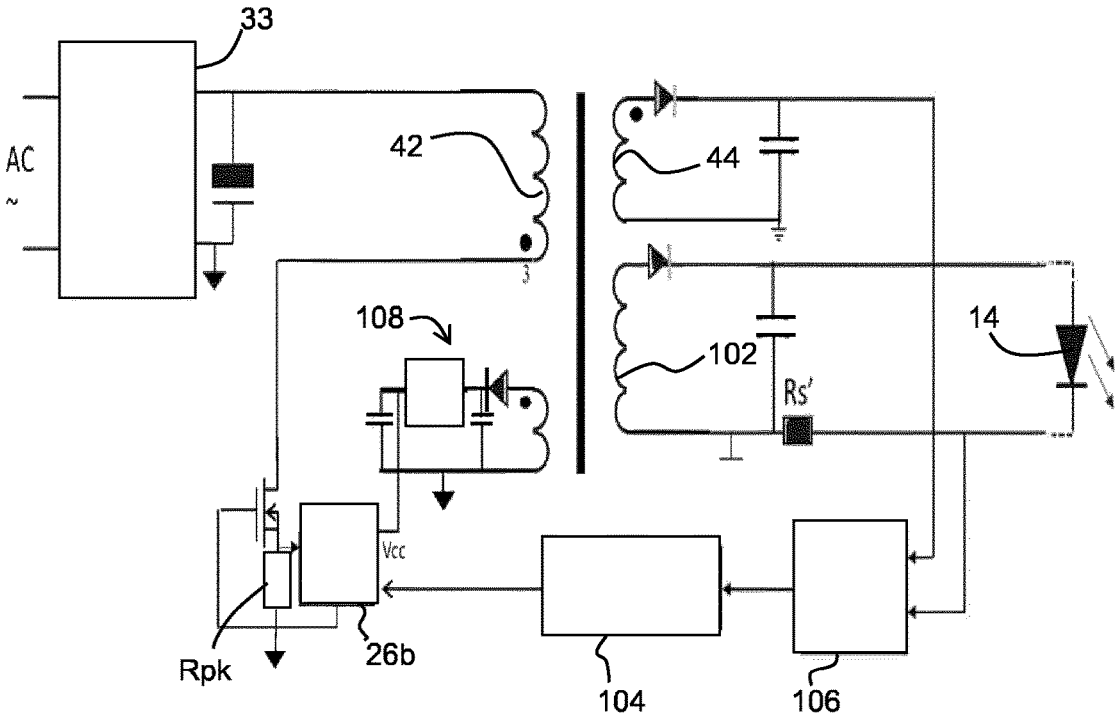
FIG. 10 shows an alternative implementation of the auxiliary driver circuit.

FIG. 10 shows an alternative implementation of the auxiliary driver circuit 24. The auxiliary modules are supplied by a power output circuit with a first secondary winding 44 and the LED lighting device is supplied by a further power output circuit with a further secondary winding 102. In this way, an isolated output is provided to the LED lighting device as well as to the auxiliary circuits.

For this type of isolated application, the auxiliary driver sensing signal Vs' (based on the current sense resistor Rs') can be transmitted to controller through signal isolators such as an opto-coupler 104 after signal processing in a signal processor 106. As in the examples above, this sensing information enables auxiliary load information calculation.

The controller **26*b* is powered by supply voltage Vcc generated by a primary side power supply circuit 108**.

The controller **26*b*** receives the primary side peak current measurement as well as the LED current measurement based on the current through current sense resistor Rs'.

The auxiliary modules may take various forms. Typically, they may comprise an RF communication device for receiving wireless control commands, or a sensor device such as for presence detection, ambient light sensing etc.

The example of 10 W and 100 W are of course just examples, and the peak lighting power and auxiliary module powers may take any suitable value. The 10% differences is also just an example—it may typically anywhere in the range 5% to 25%.

The auxiliary driver has a peak power (e.g. 10 W) sufficient to operate the auxiliary modules, and a standby power (e.g. 0.2 W) sufficient to meet to the standby power requirements. When the auxiliary modules are in standby mode or even are operated, the difference (9.8 W in this example) is able to be used for driving the LED load.

Furthermore, only one example of driver architecture has been given for the main driver and the auxiliary driver. However different power supply circuits may be used. Different switch mode power supply circuits may be used (buck, boost, buck-boost), or the power supply circuits may not be based on switch mode power supplies at all. In all cases, the (at least) two different drivers will have different efficiency performance, so that efficiency gains are possible by preferentially using one driver over the other for low power operation.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A driver arrangement for a LED lighting device with a LED light source and at least one additional auxiliary module, the driver arrangement comprising:

a main power output for providing power to the LED light source;

a main LED driver having a main power conversion circuit, the main LED driver connected to the main power output;

an auxiliary power output for providing power to the at least one additional auxiliary module;

an auxiliary driver, wherein the auxiliary driver has an auxiliary power conversion circuit independent from the main LED driver; and a controller for controlling a ratio of delivery of power from the auxiliary driver to the main power output and the auxiliary power output;

wherein the controller is adapted to communicate over a command connection to receive a dimming command of the main LED driver; and control the auxiliary driver alone to provide power to the LED light source and not use the main LED driver when the output power of the LED light source is set, in accordance with the dimming command, lower than a threshold value, wherein the auxiliary driver has a higher efficiency than that of the main LED driver at the set output power, and the main LED driver and the auxiliary driver are both adapted to power the LED light source from an AC mains.

2. The driver arrangement as claimed in claim 1, wherein the command connection is different from the AC mains, and the rate maximum power of the auxiliary driver is lower than a rate maximum power of the main LED driver (20).

3. The driver arrangement as claimed in claim 1, wherein the command connection is a wireless connection, and the controller further comprises a power control loop for the main LED driver which the power control loop comprises:

a sensor for sensing a power delivery to the LED light source from the auxiliary driver or from both of the main LED driver and the auxiliary driver and the power control loop is adapted to control the power delivery to the LED light source from the main power conversion circuit accordingly such that the power delivery to the LED light source matches an output power demand of the LED light source.

4. The driver arrangement as claimed in claim 1, wherein the controller is adapted to control the delivery of power in dependence on a power demand of the LED light source and of the at least one additional auxiliary module.

5. A driver arrangement as claimed in claim 4, wherein the controller is adapted to retrieve the power demand of the at least one additional auxiliary module by:

receiving signaling from the at least one additional auxiliary module; or detecting the output power of the auxiliary driver when it does not output power to the LED light source.

6. The driver arrangement as claimed in claim 1, wherein the controller is adapted to set the power output of the auxiliary driver to be the smaller of:

a peak output power of the auxiliary driver; and a sum of the power demand of the at least one additional auxiliary module and an output power demand of the LED light source.

7. The driver arrangement as claimed in claim 6, wherein said controller is adapted to:

maintain a peak current corresponding to the peak output power of the auxiliary driver, meanwhile regulating the voltage on the auxiliary power output, when the sum is higher than the peak output power; and maintain a current corresponding to the output power demand of the LED light source meanwhile regulate a voltage on the auxiliary power output, when the sum is lower or higher than the peak output power.

8. The driver arrangement as claimed in claim 1, wherein the auxiliary driver comprises a main power inductor and a first secondary inductor magnetically coupled to the main power inductor and adapted to connect to the at least one additional auxiliary module.

9. The driver arrangement as claimed in claim 8, wherein:

the main power inductor is adapted to connect to the LED light source in a non-isolated manner; or the auxiliary driver comprises a second secondary inductor magnetically coupled to the main power inductor and adapted to connect to the LED light source.

10. A LED lighting device comprising:

a LED light source;

at least one additional auxiliary module; and a driver arrangement including, a main power output for providing power to the LED light source;

a main LED driver having a main power conversion circuit, the main LED driver connected to the main power output;

an auxiliary power output for providing power to the at least one additional auxiliary module;

an auxiliary driver, wherein the auxiliary driver has an auxiliary power conversion circuit independent from the main LED driver; and a controller for controlling a ratio of delivery of power from the auxiliary driver to the main power output and the auxiliary power output, wherein the controller is adapted to communicate over a command connection to receive a dimming command of the main LED driver and control the auxiliary driver alone to provide power to the LED light source and not use the main LED driver when the output power of the LED light source is set, in accordance with the dimming command, lower than a threshold value, wherein the auxiliary driver has a higher efficiency than that of the main LED driver at the set output power, and the main LED driver and the auxiliary driver are both adapted to power the LED light source from an AC mains;

wherein said at least one additional auxiliary module is adapted to regulate its input power from the auxiliary driver at the auxiliary power output.

11. A LED lighting device as claimed in claim 10, wherein the at least one additional auxiliary module comprises:

an RF communication device; or a sensor device.

12. A method of controlling a supply of power from a driver arrangement to a LED lighting device with a LED light source and to at least one additional auxiliary module, the method comprising:

providing power to the LED light source using a main LED driver having a main power conversion circuit;

providing power to the at least one additional auxiliary module using an auxiliary driver, wherein the auxiliary driver has an auxiliary power conversion circuit independent from the main LED driver;

communicating over a command connection to receive a dimming command of the main LED driver; and selectively controlling a ratio of delivery of power from the auxiliary driver to the at least one additional auxiliary module and the LED light source, wherein controlling the auxiliary driver alone to provide the power to the LED light source and not use the main LED driver when the output power of the LED light source is set, in accordance with the dimming command, lower than a threshold value, wherein the auxiliary driver has a higher efficiency than that of the main LED driver at the set output power, and the main LED driver and the auxiliary driver are both adapted to power the LED light source from an AC mains.

13. The method as claimed in claim 12, comprising sensing the power delivery to the LED light source from the auxiliary driver or from both of the auxiliary driver and the main LED driver and controlling the power delivery to the LED light source from the main LED driver accordingly.

14. The method as claimed in claim 12, comprising selectively controlling the delivery of power in dependence on a power demand of the LED light source and of the at least one additional auxiliary module, and comprising setting the power output of the auxiliary driver to be the smaller of:

a peak output power of the auxiliary driver; and a sum of the power demand of the at least one additional auxiliary module an output power demand of the LED light source.

* * * * *